United States Patent [19]

Adams et al.

[11] Patent Number: 4,593,641

[45] Date of Patent: Jun. 10, 1986

[54] UNIVERSAL FRAME FOR BOAT MOUNTED GAME BLIND

[76] Inventors: Charles C. Adams, 243 N. Avalon, Memphis, Tenn. 38112; Charles H. Dickas, III, Rte. 1, Box 130, Shady Point, Okla. 74956

[21] Appl. No.: 638,393

[22] Filed: Aug. 7, 1984

[51] Int. Cl.[4] ..... B63B 17/00

[52] U.S. Cl. ..... 114/343; 114/351; 114/361

[58] Field of Search ..... 114/361, 351, 364, 343; 403/58, 83, 110, 53, 57; 135/901, 110, 101; 135/109, 113; 248/231.7

[56] References Cited

U.S. PATENT DOCUMENTS

| | | | |
|---|---|---|---|
| 1,149,762 | 8/1915 | Hendrickson | 403/110 |
| 2,513,764 | 7/1950 | Vonder | 114/361 |
| 2,714,387 | 8/1955 | Meldrum | 114/361 |
| 2,734,206 | 2/1956 | John | 114/364 |
| 2,864,391 | 12/1958 | Stark | 114/361 |
| 3,160,349 | 12/1964 | Kent | 403/110 |
| 4,106,145 | 8/1978 | Gillen et al. | 114/351 |

FOREIGN PATENT DOCUMENTS

| | | | |
|---|---|---|---|
| 570100 | 12/1957 | Italy | 114/361 |

*Primary Examiner*—Trygve M. Blix
*Assistant Examiner*—Edwin L. Swinehart
*Attorney, Agent, or Firm*—Alan Ruderman

[57] ABSTRACT

A collapsible frame structure for supporting the covering of a hunting blind on a boat, the frame structure including a pair of laterally adjustable U-shaped tubular frame members hingedly connected together. At least one of the tubular members being connected to, or received within a socket of a universal mount at each side of the boat. The socket is pivotably mounted on articulating brackets pivotably carried by a C-shaped clamp removeably clamped to each side wall of the boat and spanning the gunwales. The other of the tubular members includes members at the end thereof for abutting the gunwales spaced from the clamps. With this construction the tubualar frame members and thus the blind are readily collapsible and may be mounted and dismounted in a matter of minutes.

3 Claims, 9 Drawing Figures

UNIVERSAL FRAME FOR BOAT MOUNTED GAME BLIND

BACKGROUND OF THE INVENTION

This invention relates to boat mounted hunting blinds and more particularly to a collapsible frame for such blinds having a universal mount adapted for mounting and dismounting rapidly on various type of small boats.

Although it is well known in the art to provide hunting blinds for stationary and boat mounted use, the known blinds are difficult to set up and disassemble. Permanent type blinds have numerous disadvantages, not the least of which is that it makes navigation of the boat difficult. One such rigid blind is illustrated in Sutherland U.S. Pat. No. 4,070,722. This problem has been recognized in the prior art and numerous solutions have been proposed.

In the known proposals, as exemplified in Gillen, et al U.S. Pat. No. 4,106,145; Hinz U.S. Pat. No. 4,239,247 and Anderson U.S. Pat. No. 4,300,253, the frame of the blind is attached to the boat by means requiring a physical modification of the boat such as the drilling of holes for receiving bolts. Moreover, except for Gillen, et al, the structure of the prior art proposals are not widely adaptable to different boats without requiring modification. In Gillen, et al a set of hinge plates must be fixedly secured to the gunwale of the boat. The hinge plates pivotably carry the structural framing of the blind which is held in position by stop pins in fixed locations and the plates are such that they would not be easily angularly adjustable to different types of gunwales on the various types of boats. Gunwales, which are at the top of the sides of the boat, have various shapes and configurations for boats of various designs. In some cases they are flat, while for other boats they may have a circular bead or other cross-sectional configuration. Moreover, the sides and thus the gunwales of some boats are upright and planar while on other boats they may be inclined relative to the port and starboard side of the boat and may pitch in the longitudinal direction toward the bow and/or the stern of the boat.

SUMMARY OF THE INVENTION

Consequently, it is a primary object of the present invention to provide a blind having a collapsible frame including a universal mount which may be readily mounted on and disassembled from various types of boats.

It is another object of the present invention to provide a collapsible frame for a blind for mounting on boats having gunwales of various configurations, the frame having a universal mount adapted to be clamped to a side of the boat while straddling the gunwale.

It is a further object of the present invention to provide a blind having a collapsible frame including a universal mount which may be readily mounted on and disassembled from various types of boats, the mount being adapted for clamping to a side of the boat and having frame carrying members adjustable about three axes.

Accordingly, the present invention provides collapsible frame structure for supporting the covering of a hunting blind on a boat, the frame structure including a pair of laterally adjustable U-shape tubular frame members hingedly connected together and at least one of the tubular members being carried by universal mounts clamped at opposite sides of the boat. The mounts include a C-shape clamp removeably clamped to each side wall of the boat and straddling the gunwale of the boat sides, a first bracket member pivotably carried by each clamp for movement about a first axis generally extending horizontally in the longitudinal direction of the boat, a second bracket member pivotably carried by the first bracket member for movement about a second axis extending substantially normal to the first axis, and means for securing each end of at least one of the tubular frame members to the second bracket member for pivotable movement about a third axis extending substantially normal to the second axis so that the frame member may be moved relative to the mounts about the third axis. Thus, all the ends of the frame members may be positioned in alignment with the top of the gunwale. The other tubular frame member may merely include abutment members at the ends thereof for resting on the top of the gunwale spaced from the mounts, the location of the abutment members on the gunwales and thus the vertical height of the tubular members above the gunwale being determined by tie means attached to the central portion of the tubular members.

In the specific form of the invention the first bracket member may be pivotably hinged to the clamp at various locations for providing additional adjustability for the structure. Each of the first and second bracket members preferably comprises an L-shape member so that one leg of the second bracket member rests on and is pivotable relative to a leg of the first bracket member, the other legs of the bracket members being pivotable about studs disposed through the clamp and the end of the frame member respectively.

The present invention provides a universal mount having articulating members which adapt the frame of the blind to be mounted on the known sports boats in a matter of minutes and to be removed in a similar time. The covering for the blind is fastened to the central portion of the tubular frame members and is draped about the boat once the frame is installed.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
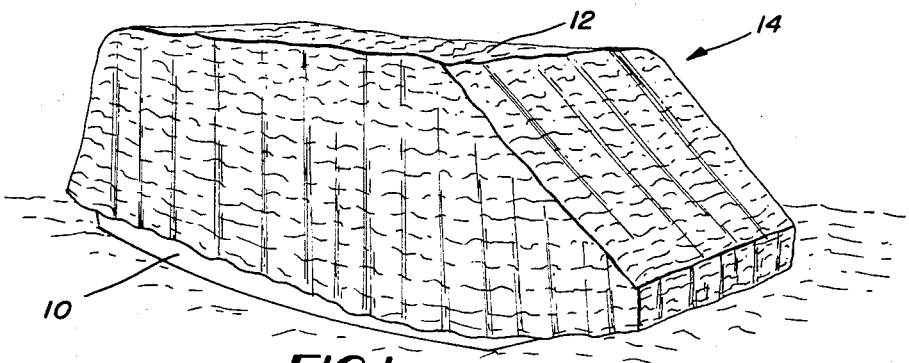
FIG. 1 is a perspective view of a sport boat incorporating a blind embodying the principles of the present invention, the blind being disposed in the operative position.
Figure 3:
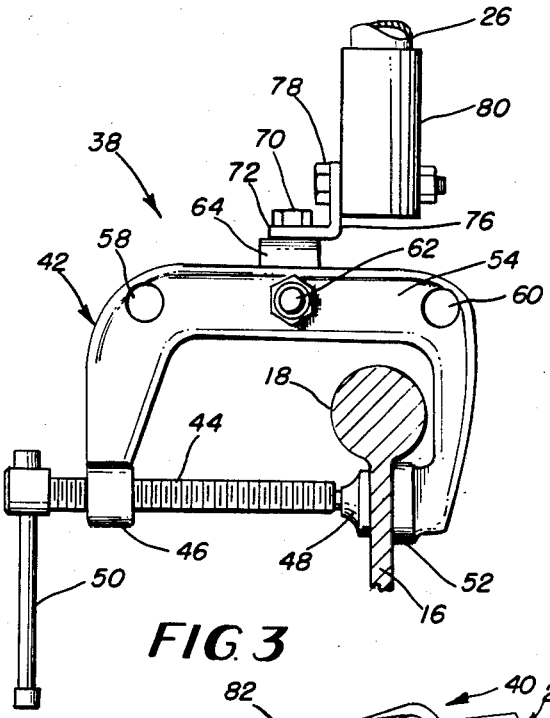
FIG. 3 is a fragmentary cross-sectional view taken through one side and gunwale of the boat in FIG. 2 illustrating the details of the universal mount of the present invention for mounting the ends of one frame member.

Referring to the drawings, FIG. 1 illustrates a boat 10 almost totally concealed by the covering 12 of a blind generally designated at 14. As is known in the art the covering 12 should comprise a camouflage patterned material which may have cuts, incising or openings (not illustrated) so that one or more hunters in the boat may peer out and extend their weapons. The boat 10 may be of any conventional design used for various water sports, and may comprise any of the conventional materials, the boat illustrated being of the aluminum type and thus the sidewalls 16 generally have a gunwale 18 including a bead or circular cross-section as illustrated in FIG. 3. However, it should be understood that the present invention is adapted for use with other gunwales such as those which are of a Tee-shape, a straight flat shape or any of the fancy molding-type shapes which boat manufacturers utilize.

The covering 12 is supported on a structural framework such as illustrated generally at 20, the specific disposition of the framework and the number of individual framework supports being dependent upon the length of the boat and the preferences of the sportsman using the boat, variations of these being illustrated in FIGS. 2 and 6 through 9 to which further reference will be made. In each of these arrangements the structure for one complete set of such framework includes first and second substantially U-shaped tubular members 22, 24 each of which comprises a pair of arms 26, 28, one at each respective side of the boat, interconnected by a cross bar 30. Preferably the arms 26, 28 are bent at the ends adjacent the cross bar and are connected to the cross bar by sleeve members 32 which act as telescoping connectors, each sleeve 32 receiving one end of the cross bar 30 and one end of one of the arms 26 or 28 respectively. Thus, the cross bar 30 is telescopically adjustable between the arms 26, 28 for variations in boat widths. The arms 26 are pivotably connected together by a hinge member 34 at a point intermediate the respective ends for folding one relative to the other, and in a similar manner the arms 28 are connected by a hinge member 36, the location of the hinges 34 and 36 being substantially the same on both sets of arms 26, 28.

Figure 2:
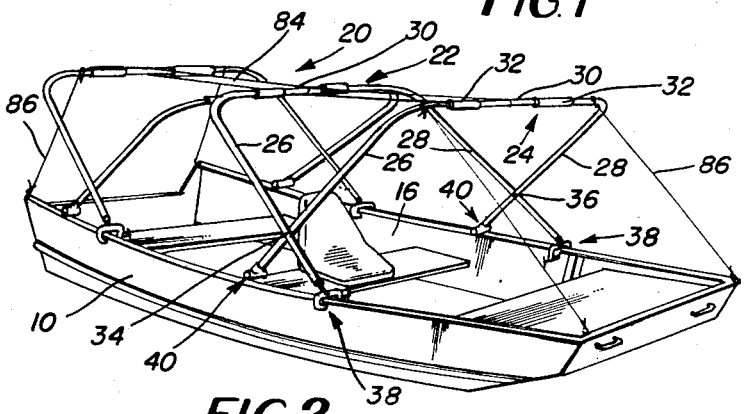
FIG. 2 is a perspective view similar to FIG. 1 but with the covering removed to show the underlying frame structure of the blind.
Figure 4:
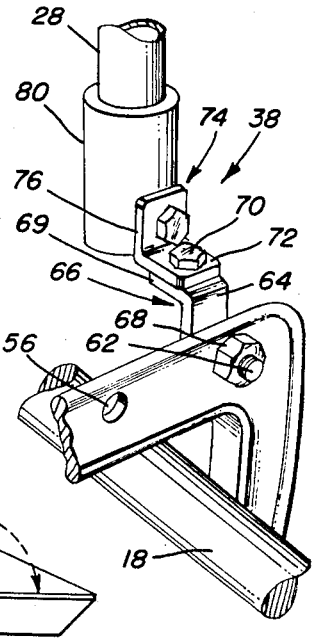
FIG. 4 is a fragmentary perspective view of the detailed portion of FIG. 3 but with portions of the mount rotated from their position in FIG. 3.

The lower end of the arms 26, 28 of at least one of the U-shape members 22, 24, e.g., member 22 in FIG. 2 is connected to the respective side of the boat by a universal mount 38 constructed in accordance with the invention and which is best illustrated in FIGS. 3 and 4 at a substantially enlarged scale. The ends of the arms 26, 28 of the other U-shape member, e.g., member 24, may also be connected by a mount 38 but, for cost effectiveness, and ease of use, it is preferred that a mere abutment structure 40 as best illustrated in FIG. 5 be utilized.

Referring to FIGS. 3 and 4, the universal mount 38 comprises a clamp 42 of a C-shape frame configuration and a threaded rod 44 adjustably received within a tapped boss 46 at one end of the clamp, the rod 44 having a pressure plate 48 at one end and a manually turnable crank 50 at the other end. The pressure plate 48 acts in conjunction with an anvil 52 at the end of the clamp remote from the boss 46. Thus, the clamp 42 may be a conventional off-the-shelf C-clamp which when connected to the boat sandwiches the side wall 16 between the plate 48 and the anvil 52 while the web 54 of the clamp straddles or spans the top of the gunwale 18. The web 54 includes one bore 56 at the central portion thereof, and preferably includes two more such bores 58, 60 adjacent respective ends thereof for selective use. Disposed within a selective one of the bores, such as 56 in FIG. 3 or 60 in FIG. 4, is a journal member 62 which may be a small bolt which first passes through and supports one leg 64 of an L-shape bracket 66 for pivotable movement on the member 62. The head of the bolt and a lock nut 68 on the end of the bolt attach the leg 64 of the bracket 66 to the clamp 42 while permitting pivotal movement of the bracket. The other leg 69 of the bracket 66 extends away from the web 54 of the clamp and has a bore through which another journal bolt 70 extends, the bolt 70 first passing through a leg 72 of a second L-shape bracket 74 to secure the brackets 66 and 74 together while permitting the bracket 74 to pivot relative to the bracket 66. The other leg 76 of the bracket 74 extends away from the bracket 66 and receives a bolt 78 which pivotably supports either the end of the respective arms 26, 28 directly or a sleeve 80 on its central portion adjacent the side of the leg 76 remote from the leg 72. If sleeve 80 is utilized, it receives and acts as a socket for a respective arm 26, 28 of the tubular member 22.

Since the bracket 66 may pivot about the substantially horizontal axis of the journal 62, and the bracket 76 may pivot about the axis of the bolt 70 which is substantially normal to the axis of journal 62, and further since the sleeve 80 may pivot about the axis of bolt 78, the latter axis being substantially normal to the axis of bolt 70, the axis of the sleeve 80 or the ends of the arms 26, 28 themselves may be adjustably positioned in a variety of dispositions. Coupled with the three holes 56, 58, and 60 in the web of the clamp, the clamp and the articulating members provide for a universal number of dispositions for supporting the tubular member 22.

Figure 5:
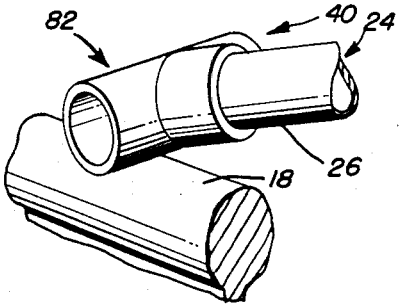
FIG. 5 is a fragmentary perspective view of the detail of the abutment for supporting another frame member of the frame of the blind.

As aforesaid, the ends of the arms 26, 28 of the tubular member 24 may be likewise supported by a universal mount, but it is preferred that the ends of those arms incude a Tee-connector 82 which merely abuts and rests upon the gunwale as illustrated in FIG. 5. This permits rapid folding of the framework 20. To preclude slipping of the tubular member 24 relative to member 22, tie means 84 in the form of straps or the like may be connected between the respective cross bars 30. A plurality of ropes, wires or the like 86 at the ends of the bow and stern of the boat act together with the framework to support the covering 12 which may be fastened to the cross bars 30 and drape over the ropes 86 and over the sides and ends of the boat.

To install the apparatus on a boat the clamps 38 need only be clamped to the side walls overlying the gunwales and the ends of the arms 26, 28 or the sleeves 80 articulated so as to overlay the gunwale and being in a disposition for receiving the respective arms 26, 28. The Tee-connectors 82 are positioned on the gunwale spaced from the clamps 38 and the straps 84 are adjusted for the desired height of the structure. When the framework is to be folded, the tubular members 24 and 26 are pivoted in the direction toward the clamps 38 and away from the Tee-connectors 86. Thus, a number of variations in mounting are possible.

Figure 6:
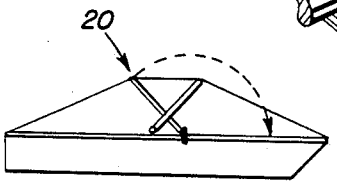
FIGS. 6 through 9 are diagrammatic depictions of variations in mounting the framework of the blind for collapsing the blind to various dispositions within a boat.
Figure 7:
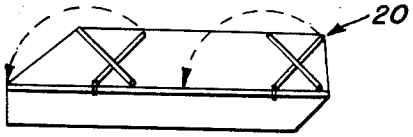
Figure 8:
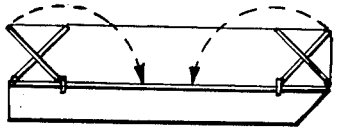
Figure 9:
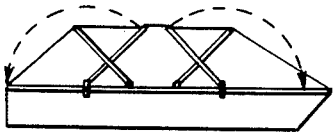

In FIG. 2 there is illustrated a mounting where two sets of framework are utilized and both are pivoted toward the bow or front of the boat, that being the right end as viewed in FIG. 2. In FIG. 6 a single frame structure is depicted which is pivotable toward the bow. In FIGS. 7 through 9 two sets of framework are utilized which are pivotable toward the stern or rear of the boat in FIG. 7, while both are pivotable toward the center and away from both the bow and stern in FIG. 8. In FIG. 9 the framework is pivotable such that one set pivots toward the bow and the other toward the stern. The direction of folding is illustrated in FIG. 6 through 9 by the directional arrows.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A collapsible frame for a hunting blind for mounting on a small boat having gunwales on the port and starboard sides, said frame including a pair of substantially U-shaped tubular members including a central cross bar and a pair of arms for spanning the boat from the port to the starboard sides, means for pivotably connecting the port side arm of a first of said members to the port side arm of the second of said members and for pivotably connecting the starboard side arm of said first member to the starboard side arm of said second member, at least one universal mount on each of said sides at substantially opposite dispositions, each mount comprising a C-shaped clamp having a manually adjustable pressure plate selectively moveable along an axis of movement toward and away from a facing anvil, said plate and anvil being spaced from a central web of said clamp for clamping opposite surfaces of a respective wall of said boat between said plate and anvil with said web disposed above and spanning the gunwale, articulating linkage means having a first bracket member pivotably mounted on said web for movement about a first axis normal to said web and spaced above said axis of movement and having a second bracket member pivotably carried by said first bracket member for movement about a second axis normal to said first axis and parallel to said web, journal means for pivotably connecting the arms of a first of said U-shaped members to a respective one of said second members for supporting said first U-shaped member for pivotable movement relative to said boat, a Tee-connector at the end of each arm of said second U-shaped member for abutting the gunwale at respective sides of the boat for adjustably supporting the arms of said second U-shaped member spaced from the arms of said first member with said cross bars spaced above said boat such that a covering may be supported on the cross bars of said U-shaped members to conceal persons in the boat and tie means adjustably connecting the cross bar of the first member to the cross bar of the second member.

2. A collapsible frame as recited in claim 1, wherein said first bracket member comprises an L-shaped bracket having one leg pivotably mounted on the web of said clamp, and said second bracket member comprises an L-shaped bracket having one leg pivotably mounted on the other leg of said first L-shaped bracket, and said journal means includes a sleeve for receiving the end of a respective arm of said first of said U-shaped members and pivotably connected to the other leg of said second L-shaped bracket for movement about an axis normal to said second axis.

3. A collapsible frame as recited in claim 2, wherein each of said cross bars is telescopically adjustable to vary the spacing between the arms of each U-shaped member.

* * * * *